US007160201B2

(12) United States Patent
Dahl

(10) Patent No.: US 7,160,201 B2
(45) Date of Patent: Jan. 9, 2007

(54) GOLF PUTTING TRAINER

(76) Inventor: Tomas Dahl, Sveagatan 23 B, SE-413 14 Göteborg (SE)

( * ) Notice: Subject to any disclaimer, the term of this patent is extended or adjusted under 35 U.S.C. 154(b) by 0 days.

(21) Appl. No.: 10/502,749

(22) PCT Filed: Jan. 30, 2003

(86) PCT No.: PCT/SE03/00155

§ 371 (c)(1),
(2), (4) Date: Jan. 10, 2005

(87) PCT Pub. No.: WO03/063971

PCT Pub. Date: Aug. 7, 2003

(65) Prior Publication Data

US 2005/0101400 A1 May 12, 2005

(30) Foreign Application Priority Data

Jan. 31, 2002 (SE) ..... 0200282

(51) Int. Cl.
*A63B 69/36* (2006.01)

(52) U.S. Cl. ..... 473/265; 473/257; 473/261

(58) Field of Classification Search ..... 473/261, 473/262, 265, 266, 272, 273, 257
See application file for complete search history.

(56) References Cited

U.S. PATENT DOCUMENTS

| | | | | |
|---|---|---|---|---|
| 2,084,902 | A * | 6/1937 | Eisenberg | 473/229 |
| 4,634,131 | A | 1/1987 | Vella et al. | |
| 4,984,802 | A | 1/1991 | Barraclough | |
| 5,209,484 | A | 5/1993 | Randall | |
| 6,364,786 | B1 * | 4/2002 | Khano | 473/257 |

OTHER PUBLICATIONS

Patent Abstracts of Japan vol. 18, No. 421 (C-1234), Aug. 8, 1994 & JP 6126010 A (Chifuku:KK), May 10, 1994 abstract, figure 1.

Database WPI Week 200105 Derwent Publications Ltd., London, GB; AN 2001-035455 & JP 2000-3000709 A (JIN X D), Oct. 31, 2000 abstract.

Database WPI Week 200006 Derwent Publications Ltd., London, GB; AN 2000-066697 & JP 11 319176 A (Miyazaki S), Nov. 24, 1999 abstract.

* cited by examiner

*Primary Examiner*—Nini F. Legesse
(74) *Attorney, Agent, or Firm*—Young & Thompson

(57) ABSTRACT

A golf putting trainer includes a holder for a putter having a shaft and a head, elements for guiding the holder in a curved movement path and elements for holding the putter head in a position perpendicular to the direction of movement of the holder. The golf putting trainer includes elements for adjusting the curvature of the movement path of the holder both vertically and horizontally.

12 Claims, 3 Drawing Sheets

GOLF PUTTING TRAINER

TECHNICAL FIELD

The present invention relates to a golf putting trainer comprising a holder for a putter having a shaft and a head, means for guiding the holder in a curved movement path and means for holding the putter head in a position perpendicular to the direction of movement of the holder.

BACKGROUND OF THE INVENTION

On a golf round about 45% of the strokes are putting strokes. It is thus essential to put good in order to be a good golfer.

In a correct putting swing the head of the putter is perpendicular to the putting line when the ball is hit. If the head is not perpendicular to the putting line the ball will spin and move away from the putting line. A golf green is however seldom totally horizontal which means that gravity influences the path of the ball. Thus, a person performing a putting stroke will therefore have difficulty in determining if path of the ball is due only to influence by gravity or if spin also had an influence.

There is therefore a need for a golf putting trainer in which a correct putting swing can be teached.

Several golf putting trainers are known. JP 2000300709 A discloses such a trainer in which a putter head is movable along a guide rail with the head rotatable around a vertical axis a certain degree. This trainer is said to make the user feel if an incorrect putting swing is performed. JP 6126010 A discloses such a trainer in which a holder for a putter is guided by arcuate rails.

The object of the present invention is to provide an improved golf putting trainer, in which a putter is moved in a path that can be vertically and horizontally curved, the curvature of the path being adjustable in order to adapt the trainer to the length and constitution of the user.

SUMMARY OF THE INVENTION

The object of the invention is obtained by a golf putting trainer comprising a holder for a putter having a shaft and a head, means for guiding the holder in a curved movement path and means for holding the putter head in a position perpendicular to the direction of movement of the holder, characterised by means for adjusting the curvature of the movement path of the holder both vertically and horizontally. By this possibility of adjusting the curvature, the putter can be made to follow the correct putting swing movement for the individual using the trainer.

In a preferred embodiment, the means for guiding the holder comprises two parallel elongate guide rails supported by a frame, the rails being attached to the frame in their forward and rear ends and in a point therebetween.

Furthermore, the trainer has means for adjusting the vertical and horizontal position of the ends of the guide rails which are arranged to move the forward or rear ends synchronously so that the guide rails always be parallel to each other. The means for guiding the holder comprises means for preventing rotation of the holder around the axis of the putter shaft and out of a plane comprising the two parallel rails.

In a first alternative, the means for guiding the holder comprises rollers running on a surface of the rails, wherein at least two rollers being displaced vertically and horizontally in relation to each other are associated with each rail.

In a second alternative, each rail comprises a groove running along the length thereof, in which rollers protruding from the holder are guided.

Advantageously, a mirror is attached to the holder and located in a plane parallel to the plane comprising the rails.

In the first embodiment the holder comprises a vertical wall being perpendicular to the elongate rails and means for removably affix the stroking face of a putter head to said wall, said wall comprising an opening for the part of the putter head comprising the sweet-spot of the putter head.

In a second embodiment of the invention, the putter is integrated in the holder.

BRIEF DESCRIPTION OF THE DRAWING

The invention will now be described with reference to the enclosed figures, of which.

DESCRIPTION OF EMBODIMENTS

Figure 1:
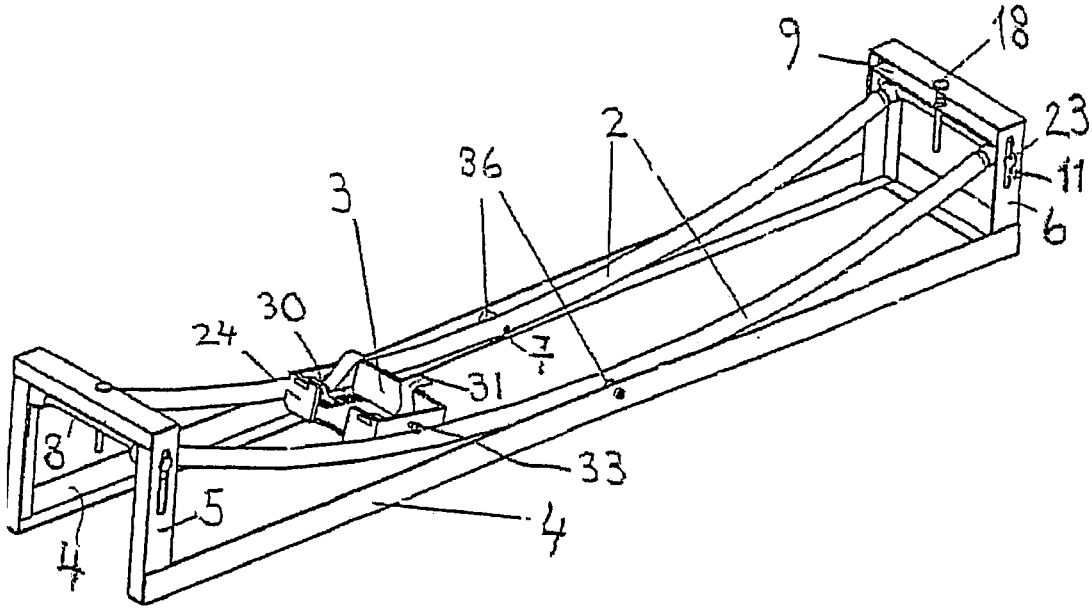
FIG. 1 shows a schematic perspective view of a golf putting trainer according to a first preferred embodiment of the invention.

A golf putting trainer according to a first preferred embodiment is shown in FIGS. 1–7. This trainer comprises a frame 1 for supporting two parallel, elongate guide rails 2 for a holder 3, in which a putter can be removably affixed. The frame 1 comprises two parallel elongate beams 4 or the like and an upstanding end part, a front end part 5 and a rear end part 6, the end parts 5,6 being attached to the front and rear ends of the beams 4. Each guide rail 2 is affixed to the adjacent beam 4 in a middle point 7 of the beam and the ends of the rails are supported by adjustment devices 8,9 arranged in the front and rear end parts 5,6 of the frame 1 to be movable in a vertical and horizontal direction. In the shown example the rails have the form of tubes having a circular section but the tubes can of course have other sections, such as square or rectangular sections. Furthermore, the rails need not be hollow and can consist of rods.

Figure 3:
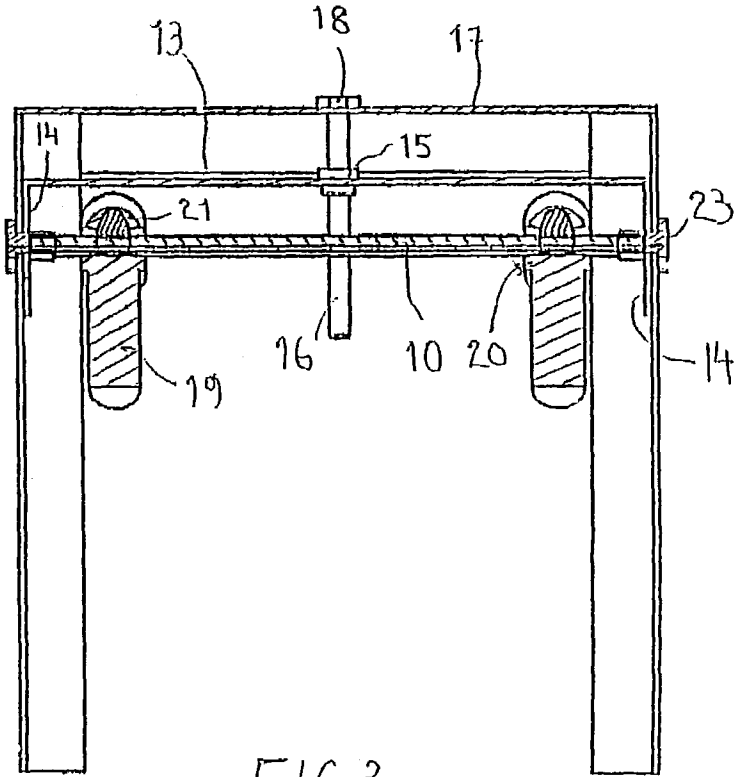
FIG. 3 shows a section along line III—III in FIG. 2.
Figure 2:
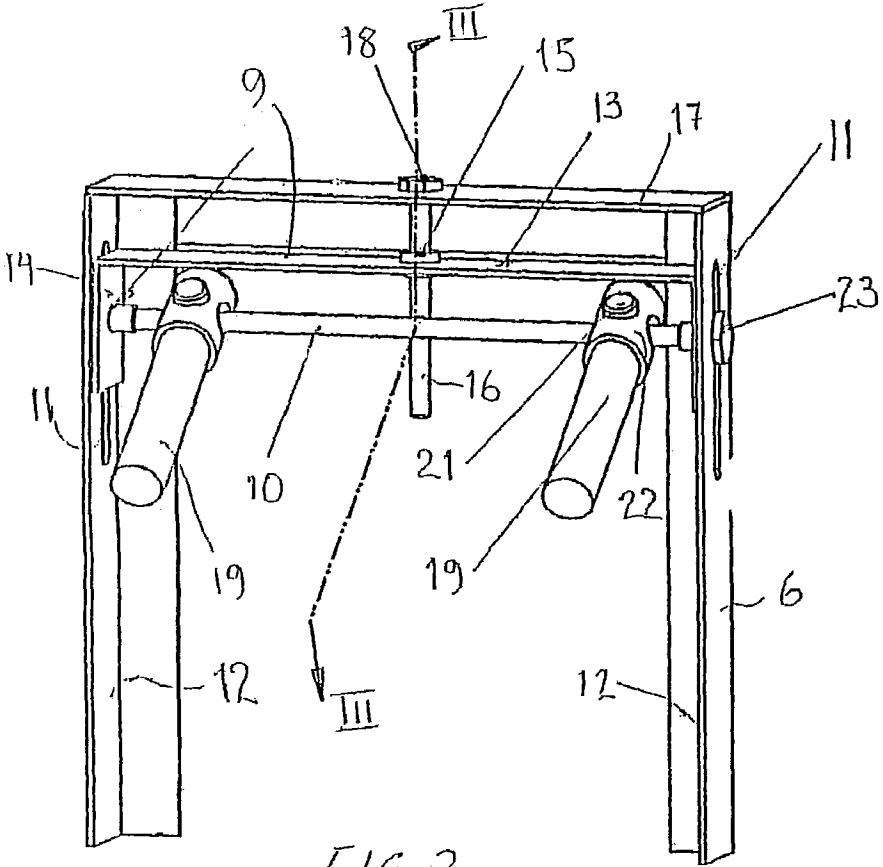
FIG. 2 shows an end part of the frame of the trainer in FIG. 1.
Figure 5:
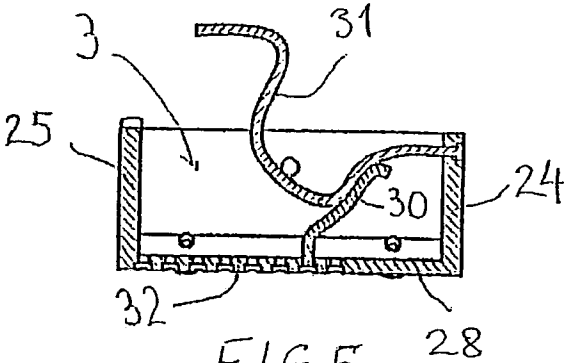
FIG. 5 shows a section along line V—V in FIG. 4.
Figure 7:
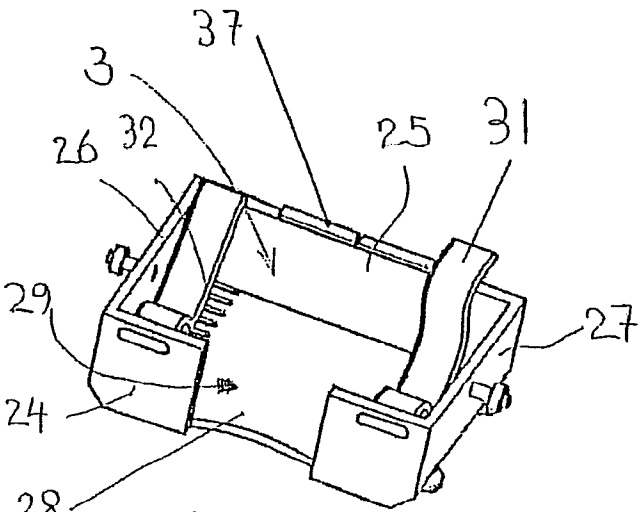
FIG. 7 shows a perspective view of the holder in FIG. 4.
Figure 4:
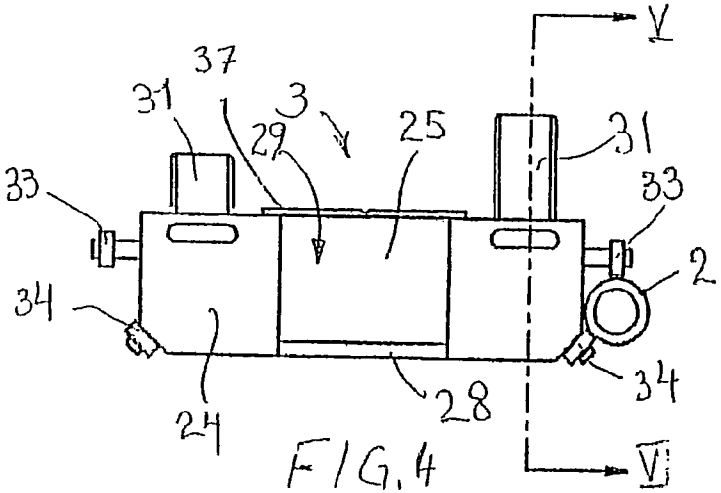
FIG. 4 shows a front view of a holder for a putter in the trainer in FIG. 1.
Figure 6:
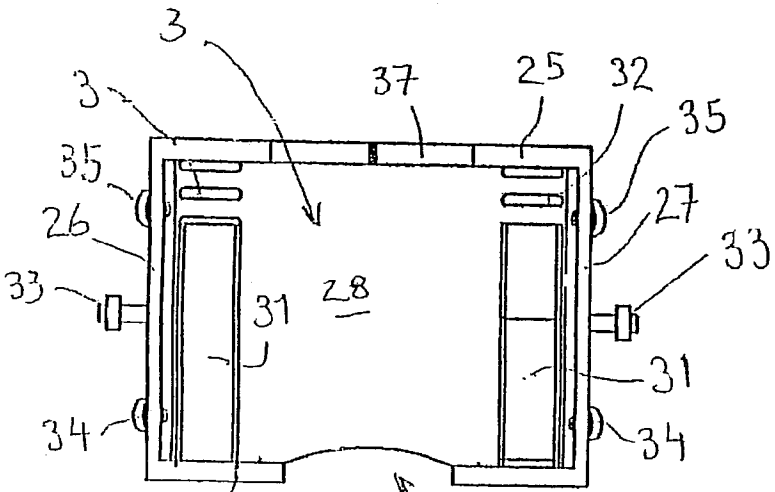
FIG. 6 shows a view from above of the holder in FIG. 4.

In FIGS. 2 and 3 the adjustment device 9 arranged in the rear end part 6 is disclosed. The adjustment device 9 comprises a transversely extending rod 10 which ends are slidable in a vertical plane perpendicular to the length direction of the beams 4 in vertical slots 11 provided in the vertically extending side beams 12 of the rear end part 6. This rod is rotatably supported in a transverse bar 13 having downwards directed flanges 14 abutting the insides of the side beams 12 of the rear end part 6. The bar 13 is in the middle thereof provided with a nut 15 co-operating with a threaded bolt 16 being rotatably supported in the upper crossbeam 17 of the rear end part 6. By rotating the head 18 of the bolt 16 in opposite directions the bar 13 and thereby the rod 10 can be moved upwards and downwards in the slots 11.

The adjustment device 9 also comprises two attachment rods 19 for attaching the rear ends of the rails 2 to the adjustment device. The rear ends of these attachment rods are supported by the transverse rod 10 which run through holes 20 in the rear end portions of the attachment rods 19. The rear end portions of the attachment rods 19 also comprises holes perpendicular to the holes 20 in taps 21 are provided. These taps 21 are affixed to a sleeve 22 having holes corresponding to the holes 20 for the passage of the transverse rod 10 and threaded holes for the affixing of the taps 21. The transverse rod 10 is threaded at least in parts and the undersides of the taps comprise threads co-operating with the threads on rod 10. The outer ends of the rod 10 are provided with heads 23. By rotating these heads 23 the attachment rods 19 can be laterally moved back and forth. The holes 20 have the form of a double cone with bases directed outwards in order to permit angular displacement of the attachment rods 19 in relation to the rod 10. The rear end portions of the rails 2 are slidably attached to the attachment rods 19.

The adjustment device 8 for the front ends of the rails 2 is constructed in the same way as the adjustment device 9 for the rear ends of the rails 2 and need not be described further.

FIGS. 4–7 show a first preferred embodiment of the holder 3 for a putter. The holder 3 comprises a front wall 24, a rear wall 25, two side walls 26,27 and a bottom wall 28. The front wall 24 has an opening 29, in which the central part of a putter head is to be placed. A resilient element 30 is protruding upwards from the bottom wall 28 on both sides of the opening 29 in the front wall and a self-locking band 31 such as a Velcro™ band co-operating with each element 30 is attached in the front wall and can operated to press this element downwards. Thereby a putter head placed between the elements 30 can affixed to the holder 3 with its stroking face pressing against the front wall and its bottom face pressed against the bottom wall 28. The resilient element 30 can for example be a metal piece. In the bottom wall two rows of openings 32 for accommodating the elements 30 are arranged so that the location of these elements can be adapted to the type of putter head to be attached to the holder.

On the side walls 26, 27 of the holder, rollers 33,34 and 35 are arranged to co-operate with the rails 2 so that the holder is unable to rotate in or move out of the plane comprising the rails 2. This is accomplished by displacing the rollers 34,35 from the roller 33 both vertically and lengthwise.

The described putting trainer functions in the following way.

Firstly, the trainer is adapted to the individual who is to use the trainer. For a long individual the radius of the swing is larger than for a shorter individual provided they use the same putting grip. This means that for a short individual the ends of the rails 2 must be higher up than for a long individual. The ends of the rails 2 are also adjustable sideways, i.e. laterally in relation to the length direction. However, the differences of the radius of the swing in a horizontal plane are much smaller than for the differences of the radius in a vertical plane.

After the trainer has been adapted to the individual using it, the head of the putter attached to the holder will always follow the correct movement path, hitting the ball in a position perpendicular to the putting line, i.e. a line parallel to the length direction of the rails 2. When the ball is hit by a correct putting stroke, the head of the putter should be slightly above ground. This means that in the lowest position during its movement, the bottom of the holder should almost touch the ground. Therefore, the rails 2 are placed within the height region of the beams 4 of the frame in their attachment points 7 and a distance on the front and rear sides thereof. In order to allow movement of the rails 2 in a direction perpendicular to the rails 2, the rails are distanced from the beams 4 and attached thereto via distance elements 36, as can be seen in FIG. 1.

Thus, a putter attached to the holder 3 will always perform a correct putting stroke. All the individual using the trainer has to do is to grip the shaft of the putter, swing and follow the movement of the putter. A correct putting stroke will thereby be learned by motor learning.

The holder 3 is advantageously also provide with a horizontally disposed mirror 37 having a marking in the middle thereof representing the position of the sweetspot of the putter. This makes it possible for the user to check that he has his/her eyes directly above the ball, which is essential for the aim. When the trainer is used together with a ball, the ball should be placed in the middle of a line between the attachment points 7 of beams 4.

Figure 8:
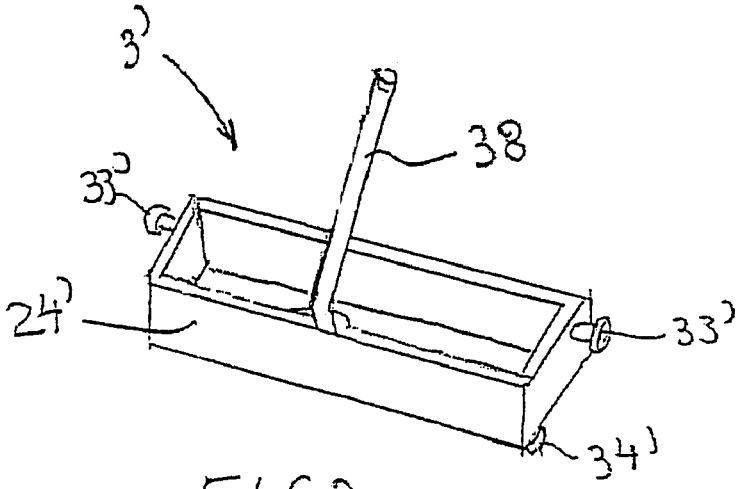
FIG. 8 shows a perspective view of a holder according to a second embodiment.

In FIG. 8 a holder 3' according to a second embodiment of a putting trainer is schematically shown. The putting trainer according to the second embodiment differs from the putting trainer according to FIGS. 1–7 only in that a putter is integrated in the holder and that the side walls only support two rollers 33', 34' instead of three rollers as in the first embodiment. Otherwise this trainer is constructed in the same way as the trainer according to FIGS. 1–7 and need not be further described. The putter integrated in holder 3' has a shaft 38 protruding from the front wall 24', which thereby constitutes the putter head.

The described embodiments can of course be modified in several ways without leaving the scope of the invention. For example, the rails can have grooves along the length thereof, in which rollers are guided. Furthermore, resilient clamping devices or other means can be used to attach a putter head to the holder. The attachment rods can be made angularly displacable with the aid of universal joints instead of holes having the form of double cones or by being made of a bendable material. The attachment rods need no be rods but can be tubes fitting onto or into the end portions of the rails. The bottom wall of the holder can consist of one or several bars instead of a plate as in the disclosed embodiments. The adjustment devices can be different from the described devices, for example can the front and rear end parts of the frame be laterally movable as a whole in order to accomplish the sidewise movements of the rail ends and the side beams of the front and rear end parts can be made of two telescopic portions. The scope of invention should therefore only be restricted by the content of the enclosed set of patent claims.

The invention claimed is:

1. Golf putting trainer comprising:

a holder for a putter having a shaft and a head, means for guiding the holder in a curved movement path, means for holding the putter head in a position perpendicular to the direction of movement of the holder, and means for adjusting the curvature of the movement path of the holder both vertically and horizontally.

2. Golf putting trainer according to claim 1, wherein said means for guiding the holder comprises two parallel elongate guide rails supported by a frame, the rails being attached to the frame at their forward and rear ends and at a point therebetween.

3. Golf putting trainer according to claim 2, wherein said means for adjusting the curvature of the movement path comprises means for adjusting vertical and horizontal positions of the ends of the guide rails.

4. Golf putting trainer according to claim 3, wherein said means for adjusting the vertical and horizontal position of the ends of the guide rails are arranged to move the forward or rear ends synchronously so that the guide rails are always parallel to each other.

5. Golf putting trainer according to claim 2, wherein said means for guiding the holder comprises means for preventing rotation of the holder around the axis of the putter shaft and out of a plane comprising the two parallel rails.

6. Golf putting trainer according to claim 5, wherein said means for guiding the holder comprises rollers running on a surface of the rails, wherein at least two of said rollers are displaced vertically and horizontally in relation to each other.

7. Golf putting trainer according to claim 2, further comprising a mirror attached to the holder and located in a plane parallel to the plane comprising the rails.

8. Golf putting trainer according to claim 2, wherein said holder comprises a vertical wall that is perpendicular to the elongate rails and means for removably affixing a stroking face of a putter head to said wall, said wall comprising an opening for the part of the putter head comprising the sweet-spot.

9. Golf putting trainer according to claim 1, further comprising a putter integrated in the holder.

10. A golf putting trainer, comprising:

a frame that includes a longitudinally extended base with upwardly depending distal ends, each of said ends carrying a laterally extended rod that is movable vertically relative to said base;

two parallel guide rails that together define an arcuate path, each of said rails having ends that are each attached to a respective said rod and a central part that is attached to said base;

each of said rods having a laterally threaded part along which the ends of said rails move laterally; and a putter holder that moves along the arcuate path defined by said rails, said putter holder having two pairs of spaced apart wheels that hold said putter holder to said rails.

11. The trainer of claim 10, wherein each of said distal ends comprises a pair of spaced apart vertical slots that receive respective ends of said rod, a laterally extended bar with ends that also receive respective ends of said rod, and an adjustment bolt that moves said bar vertically to cause said rod to move vertically and remain parallel to said base.

12. The trainer of claim 11, further comprising a rotatable adjustment head that extends from one end of said rod beyond a respective one of said slots and that is connected to said threaded part so that rotation of said adjustment head causes rotation of said threaded part and lateral movement of the respective ends of said rails.

* * * * *